US009312083B1

(12) United States Patent
Czarnecki

(10) Patent No.: US 9,312,083 B1
(45) Date of Patent: Apr. 12, 2016

(54) THREADED ROD-AND-SPACER SWITCH HANDLE TIE

(71) Applicant: Reliance Controls Corporation, Racine, WI (US)

(72) Inventor: Neil A. Czarnecki, Mt. Pleasant, WI (US)

(73) Assignee: Reliance Controls Corporation, Racine, WI (US)

( * ) Notice: Subject to any disclaimer, the term of this patent is extended or adjusted under 35 U.S.C. 154(b) by 124 days.

(21) Appl. No.: 14/090,217

(22) Filed: Nov. 26, 2013

(51) Int. Cl.
*H01H 9/26* (2006.01)
*H01H 13/72* (2006.01)
*H01H 13/76* (2006.01)

(52) U.S. Cl.
CPC ..... *H01H 9/26* (2013.01)

(58) Field of Classification Search
CPC ..... H01H 9/20; H01H 9/26; H01H 13/72; H01H 13/76; H01H 3/00; H01H 3/02; H01H 3/04; H01H 3/54; H01H 71/00; H01H 71/02; H01H 71/0214; H01H 71/0264; H01H 71/10; H01H 71/50; H01H 2071/10; H01H 2071/1009
USPC ..... 200/333, 43.01, 43.11, 43.14–43.16, 200/43.19, 43.22, 50.32
See application file for complete search history.

(56) References Cited

U.S. PATENT DOCUMENTS

| | | | | |
|---|---|---|---|---|
| 3,272,934 | A | 9/1966 | Schwartz et al. | |
| 3,299,231 | A | 1/1967 | Camp et al. | |
| 3,703,614 | A | 11/1972 | Zubaty et al. | |
| 3,801,758 | A | 4/1974 | Shand et al. | |
| 4,328,401 | A | 5/1982 | Carr | |
| 4,644,114 | A | 2/1987 | Strobel | |
| 4,980,525 | A | 12/1990 | Kakisako | |
| 5,172,087 | A | 12/1992 | Castonguay et al. | |
| 5,648,646 | A * | 7/1997 | Flegel | 200/50.32 |
| 5,686,709 | A | 11/1997 | Casagrande et al. | |
| 6,137,069 | A | 10/2000 | Casagrande et al. | |
| 6,541,719 | B1 * | 4/2003 | Powell | 200/50.32 |
| 6,861,596 | B2 | 3/2005 | Schnackenberg | |
| 7,482,646 | B2 | 1/2009 | Gao et al. | |
| 7,566,841 | B2 | 7/2009 | McCoy | |
| 7,795,550 | B2 | 9/2010 | McCoy | |
| 8,008,585 | B2 | 8/2011 | Mills et al. | |

* cited by examiner

*Primary Examiner* — Renee S Luebke
*Assistant Examiner* — Anthony R. Jimenez
(74) *Attorney, Agent, or Firm* — Boyle Fredrickson, S.C.

(57) ABSTRACT

A switch coupling assembly is configured for coupling switch handles to provide simultaneous actuation and deactivation of an electrical device. The switch handles are arranged in a side by side configuration and have passages are aligned. A coupling rod is inserted through the passages in the handles. A spacer is positioned between the switch handles and receives the coupling rod therethrough. An outside surface of the coupling rod is threaded to interact with either or both of the inner surface of the spacer or the inner surface of the handles in order to prevent inadvertent axial motion of the rod relative to the spacer or the switch handles.

15 Claims, 6 Drawing Sheets

THREADED ROD-AND-SPACER SWITCH HANDLE TIE

CROSS-REFERENCE TO RELATED APPLICATIONS

--

BACKGROUND OF THE INVENTION

The present invention relates to a switch coupling assembly for coupling switch handles, and more particularly, pertains to a switch coupling assembly which couples a plurality of electric switch handles and a spacer in an aligned orientation with a threaded rod, wherein the spacer and/or the switch handles are also threaded to prevent inadvertent movement of the rod.

In many electrical installations, it may be desirable to provide simultaneous switching of electric switch handles, e.g., circuit breaker handles, of separate electrical units. This may occur, for example, when circuits are protected by separate single-pole circuit breakers but it is necessary for the circuits to remain in the same conducting state, or for circuits protected by two-pole circuit breakers that require both legs of the circuit breaker to simultaneously disconnect. Thus, it becomes necessary to connect two or more switches or circuit breaker handles together so that they may operate simultaneously and actuate or disconnect at the same time.

Specifically, in power distribution applications this requirement may be found in multiwire branch circuits which consist of two or more ungrounded conductors that have a voltage between them, and a grounded conductor that has equal voltage between it and each ungrounded conductor of the circuit and that is connected to the neutral or grounded conductor of the system. Multiwire branch circuits can be extremely dangerous if the ungrounded circuit conductors are not all deenergized when equipment supplied from a multiwire circuit is being serviced. For this reason, all ungrounded conductors of a multiwire branch circuit must be simultaneously disconnected to reduce the risk of electric shock to users working on equipment.

For example, in 240 volt alternating current (VAC) circuits, connecting two switches is commonly required because one switch or circuit breaker controls one 120 VAC leg of the circuit while the second switch or circuit breaker controls the other "out of phase" 120 VAC leg. In a 120/240 VAC system, the center winding of the transformer is tied to ground so a 240 VAC circuit is achieved, but very dangerous amounts of voltage are also produced. Unless both legs are broken during service and maintenance activities, a functional power circuit exists between the unbroken leg and any grounded metal part. Thus, it is a necessity to assure that when the circuit is deenergized, both legs are also deenergized. This can be done by a mechanical device which physically connects the operating handles of the two switches or circuit breakers together so that the legs are always in the same conducting state.

Existing methods for switch ties generally involve brackets, clips or bars that must be attached, either by fasteners or protrusions, to the switches or brackets of interest. Often, they are clumsy additions to the pre-existing design of the switch or breaker. Therefore, an improved simple and unobtrusive switch tie device is desired. It is an additional object of the present invention to prevent axial motion of a coupling rod without the use of a retainer or washer.

SUMMARY OF THE INVENTION

The present invention is generally directed to an apparatus and method relating to a switch tie assembly for coupling switch handles. In one embodiment a switch coupling assembly includes a coupling rod and at least two switches of at least one electrical circuit arranged side by side and each having a switch handle movable to an on and offstate for actuating an electrical component. The switch handles have aligned passages, which receive the coupling rod therethrough for coupling the switch handles in a common orientation. A spacer is positioned between the switch handles and has a passage adapted to be placed into alignment with the passages of the switch handles for receiving the rod therethrough for coupling the switch handles to the spacer.

In one embodiment, the inner surface of the spacer passage is threaded and an outer surface of the coupling rod is threaded, and the threads are configured to interlock and prevent inadvertent axial motion of the coupling rod relative to the spacer.

In one aspect the coupling rod may be threaded at an area disposed within the spacer passage when the coupling rod is received within the switch handle passages and the spacer passage, and the area of the rod disposed within the passages of the switch handles may be unthreaded.

In another aspect the coupling rod may be a metal screw.

In another aspect the spacer may be cylindrical and the passage of the spacer may extend between opposite ends defined by the spacer.

In another aspect the switch handles may be disposed within an electrical switch housing adapted to fit within a transfer switch panel.

In another aspect the switch may be a circuit breaker.

In an alternative embodiment, a switch coupling assembly includes a coupling rod and at least two switches of at least one electrical circuit arranged side by side and each having a switch handle movable between an on and off state for actuating an electrical component. The switch handles have aligned passages which receive the coupling rod therethrough for coupling the switch handles in a common orientation. A spacer is positioned between the switch handles and has a passage adapted to be placed into alignment with the passages of the switch handles for receiving the rod therethrough for coupling the switch handles to the spacer. The inner surfaces of the switch handle passages are threaded and an outer surface of the coupling rod is threaded, and the threads are configured to interlock and prevent inadvertent axial movement of the coupling rod relative to the switch handles.

In one aspect the coupling rod may be threaded at an area disposed within the switch handle passages when the coupling rod is received within the switch handle passages and spacer passage, and the area disposed within the spacer passage may be unthreaded.

The present invention also contemplates a method of connecting switch handles together by providing a switch coupling assembly having a rod, at least two switches arranged side by side and each having a switch handle movable to an on and off state for actuating an electrical component and having passages. The passages are aligned, and receive the coupling rod therethrough for coupling the switch handles in a common orientation. The method involves placing a spacer between the switch handles. The spacer has a passage for receiving the rod therethrough for coupling the switch handles to the spacer. The inner surface of at least one of the spacer passage and the switch handle passages are threaded and an outer surface of the rod is threaded to prevent inadvertent axial motion of the rod relative to the spacer or switch handles. The rod is inserted through the passages in the switch handles and the spacer to fixedly align the handles and provide simultaneous movement.

These and other features and aspects of the present invention will be better appreciated and understood when considered in conjunction with the following description and the accompanying drawings. It should be understood, however, that the following description, while indicating a representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in die several views, and in which.

Figure 1:
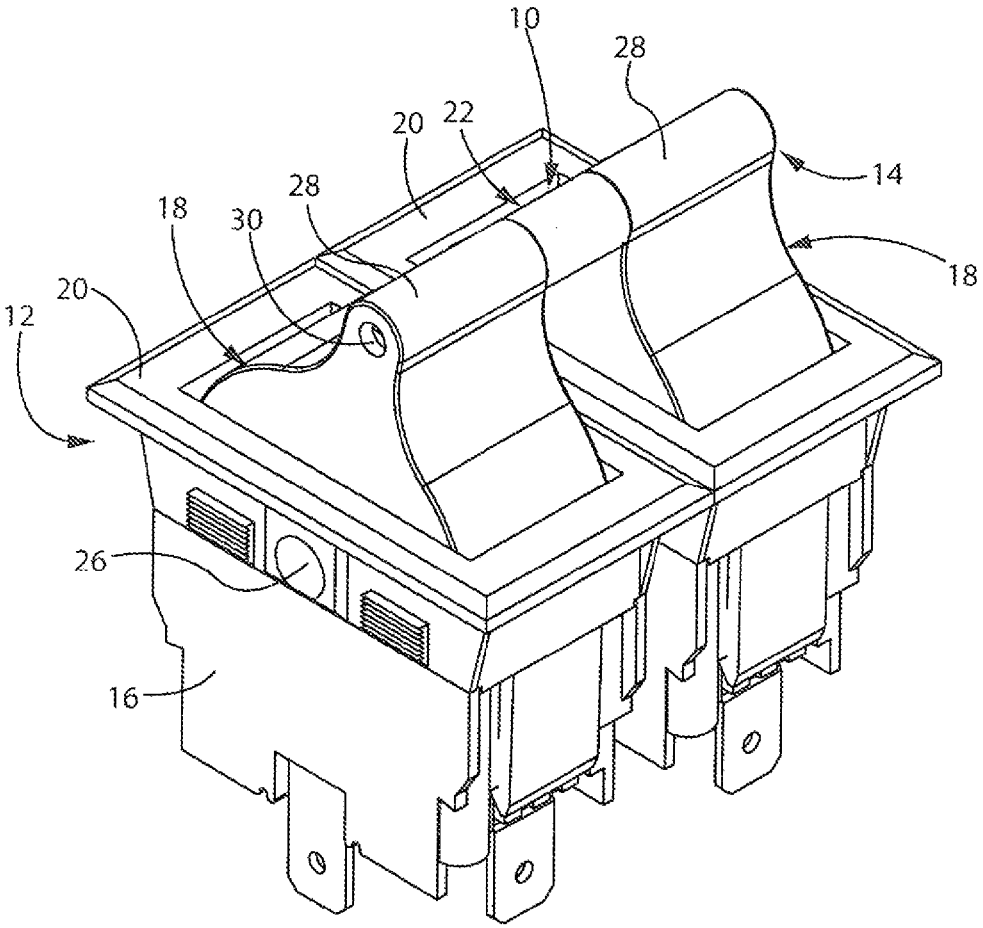
FIG. 1 is an isometric view of a handle tie assembly for switch handles, in accordance with the present invention, showing two electrical switches removed from an electrical assembly and coupled together.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION OF THE DRAWINGS

The various features and advantageous details of the subject matter disclosed herein are explained more fully with reference to the non-limiting embodiment described in detail in the following description.

This invention relates to a switch coupling assembly for coupling switch handles, and more particularly, pertains to a switch coupling assembly for electrical switches which couples a plurality of electrical switch handles and a spacer in an aligned orientation with a threaded rod, wherein the spacer and/or the switch handles are also threaded to prevent inadvertent axial movement of the rod.

Referring to FIG. 1, an isometric view of a switch coupling assembly 10 in accordance with one embodiment of the present invention is shown. As shown, the switch coupling assembly 10 may be utilized to couple electrical switches 12, 14 of, for example, circuit breaker handles or transfer switches. The electrical switches 12, 14 are generally arranged in close proximity, and may be oriented adjacent to each other to facilitate coupling. It is understood that the switch coupling assembly 10 of the present invention may be used to couple switches of any type and number where simultaneous actuation of two or more switches is desired.

Figure 2:
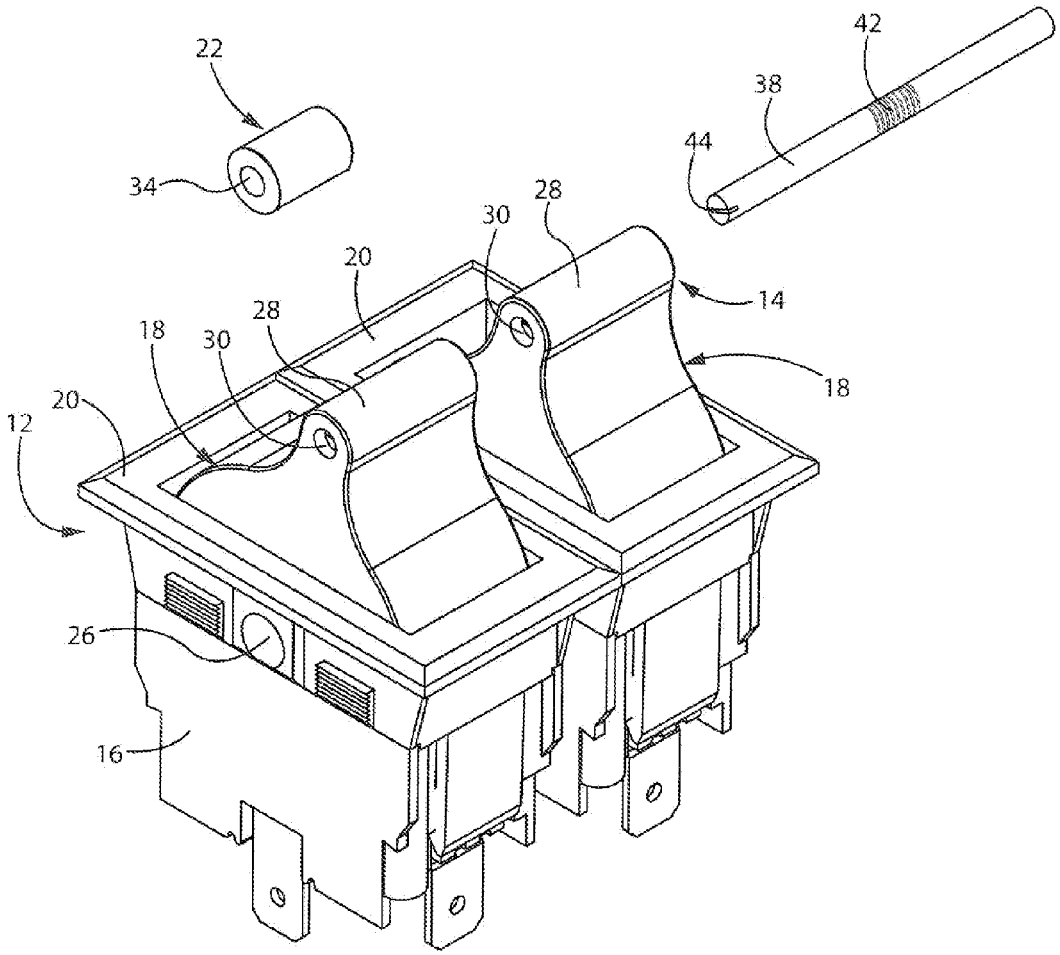
FIG. 2 is an isometric view of the handle tie assembly of FIG. 1 showing the rod and spacer of the handle tie assembly removed from the switch handles and the switch handles uncoupled.

Referring now to FIGS. 1 and 2, the switch coupling assembly 10 facilitates the coupling of two or more electrical switches 12, 14 so that they may actuate simultaneously. The electrical switches 12, 14 may include a number of components which are assembled together to form a single electrical switch arrangement in a manner as is generally known, and may include a lower housing 16 that may be configured to be received within a circuit breaker panel (not shown), a switch handle 18 disposed within the lower housing 16 for movement between ON and OFF positions, and an enclosure cover 20 for retaining the switch handle 18 within the lower housing 16. Representatively, the switches 12, 14 may have a configuration as shown and described in Czarnecki et al. U.S. Pat. No. 7,009,128 issued Mar. 7, 2006, the entire disclosure of which is hereby incorporated by reference.

It is understood that the electrical switches 12, 14 may actuate separate electrical circuits or different legs of the same electrical circuit and are carried by separate switch housings. However, simultaneous actuation of the switches 12, 14 may be desired for a variety of reasons, some of which are described above and which may include safety requirements. The electrical switches 12, 14 are generally positioned adjacent to one another or side-by-side, as the switch housing allows. However, it is understood that the switches 12, 14 may be oriented in other arrangements that allow the switch coupling assembly 10 to couple the switch handles 18. It is also understood that more than two switches may be coupled together by providing more than one switch coupling assembly 10 or switch coupling assembly parts as required and understood by one skilled in the art.

Still referring to FIGS. 1 and 2, the switch coupling assembly 10 may include a spacer 22 and an elongated rod 38 which are used in connection with threaded passages 30, 34 of the switch handles 18 and/or spacer 22 as will be further described herein. The switch handles 18 are shown as being pivotably mounted between spaced-apart walls of the enclosure cover 20 via a pivot pin 26. An upper end of the switch handles 18 includes bottleneck-shaped switch handle tabs 28 allowing the user to manually grasp and pivot the switch handles 18. Pivoting movement of the switch handle tabs 28 operates the electrical switches 12, 14 as commonly known in the art. It is understood that the switch handles 18 and switch handle tabs 28 may be any shape or size as known in the art.

Switch handle passages 30 are provided in the switch handle tabs 28 in a longitudinal direction and extending between opposite ends of the switch handles 18. The passages 30 extend along a longitudinal axis that is generally parallel to the longitudinal axis of pivot pin 26 so that pivoting motion is not inhibited by the switch coupling assembly as will be further described herein. The inner walls 32 of the passages 30 may be threaded or unthreaded as will also be further described herein.

A spacer 22 is sized to fit between the switch handle tabs 28 of the switch handles 18 and to encompass substantially the entire space provided between the switch handles tabs 28. The spacer 22 is shown as having a cylindrical construction and having a length, which extends longitudinally between the switch handles 18. It is understood that the spacer 22 may have any shape or size which bridges the space between the switch handles 18.

A spacer passage 34 is provided in the spacer 22 in a longitudinal direction and extending through the length of the spacer 22. The spacer passage 34 may have a generally similar cross sectional opening size and shape as passages 30 provided through switch handle tabs 28. The inner walls 36 of the spacer 22 may be threaded or unthreaded as will be further described herein.

The elongated rod 38 is sized to fit within passage 30 of the switch handle tabs 28 and passage 34 of spacer 22 and to be threaded therein. The elongated rod 38 may have a length commensurate with the length provided by the span of the switch handles 18, or may extend a length less than the entire span of the switch handles 18 as long as a portion of the rod 38 extends within the switch handle passages 30 to restrict independent motion. The elongated rod 38 may be threaded at selected areas or may be threaded its entire length as will be further described herein.

In operation, the switch coupling assembly 10 is constructed by arranging the switch handles 18 desired to be coupled together so that the switch handle passages 30 are aligned in a common orientation. The spacer 22 is then positioned between the switch handles 18 so that the spacer passage 34 is aligned in a common orientation with the switch handle passages 30. The elongated rod 38 is then inserted through the passages 30, 34 so that the switch handles 18 and spacer 22 are restricted to simultaneous pivoting movement by the rod 38. The ends of the rod 38 may terminate within the switch handle passages 30, at the mouth of the switch handle passages 30, or exterior to the switch handle passages 30. As noted above, the elongated rod 38 extends parallel to the pivot pin 26 so that pivoting motion of the switch handles 18 is not restricted by the extension of the rod 38 within the passages 30, 34. The common orientation of the elongated rod 38 and pivot pin 26 ensure the pivoting motion is still permitted in a generally perpendicular direction to the rod 38 and pin 26. As will be further described herein, the rod 38 and spacer and/or switch handle tabs 28 are threaded to prevent inadvertent axial movement of the rod 38.

Figure 3:
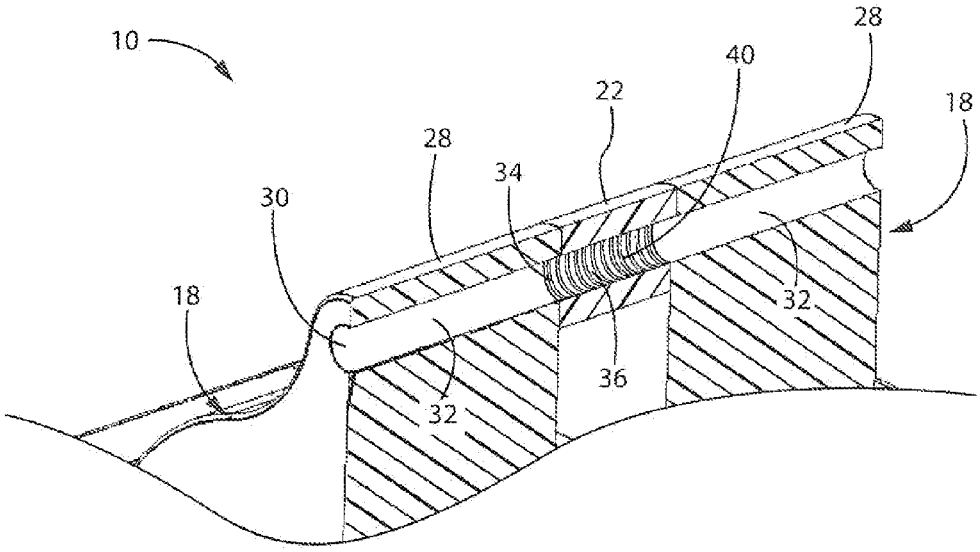
FIG. 3 is a partial section view of a first embodiment of the handle tie assembly in accordance with present invention with the rod removed and showing a threaded surface in the spacer passage.
Figure 4:
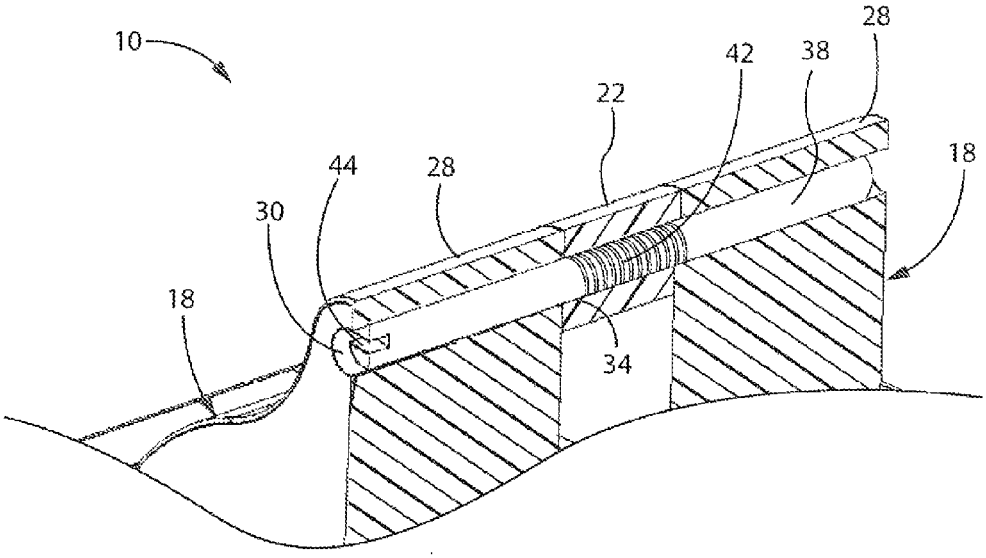
FIG. 4 is a partial section view of the handle tie assembly of FIG. 3 with the rod inserted therein and showing an outer surface of the rod having a threaded surface.

Referring now to FIGS. 3 and 4, one embodiment of the present invention is shown having a first threaded arrangement of the switch coupling assembly 10. As shown, the inner walls 36 of the spacer 22 have internal threads 40. Corresponding external threads 42 are provided on the elongated rod 38 at a middle section disposed within the passage 34 of the spacer 22. The outer sections disposed within the passages 30 of the switch handles 18 may or may not be threaded.

As previously described, the switch coupling assembly 10 is assembled by aligning the passages 30, 34 of the switch handles 18 and the spacer 22. The elongated rod 38 is then inserted therethrough the passages 30, 34 by rotating the rod 38 so that the external threads 42 interlock with internal threads 40 and the rod 38 is allowed to advance linearly through the passages 30, 34. Thereafter, linear motion of the rod 38 is prevented so long as rotational force is not present.

While it is contemplated that the rod 38 generally extends the entire span of the switch handles 18, the rod 38 may terminate within the passages 34 of the switch handles 18 if the rod length is less than the span of the switch handles 18, as shown. The rod 38 may include notches 44 at opposite ends so that the rod 38 may be rotated by a screwdriver or other tool to assist in installation of the rod 38 through passages 30, 34. Additionally, the notches 44 facilitate installation of the rod 38 when the rod 38 ends terminate within the switch handle passages 30 and rotation of the rod 38 is more difficult to achieve.

Figure 5:
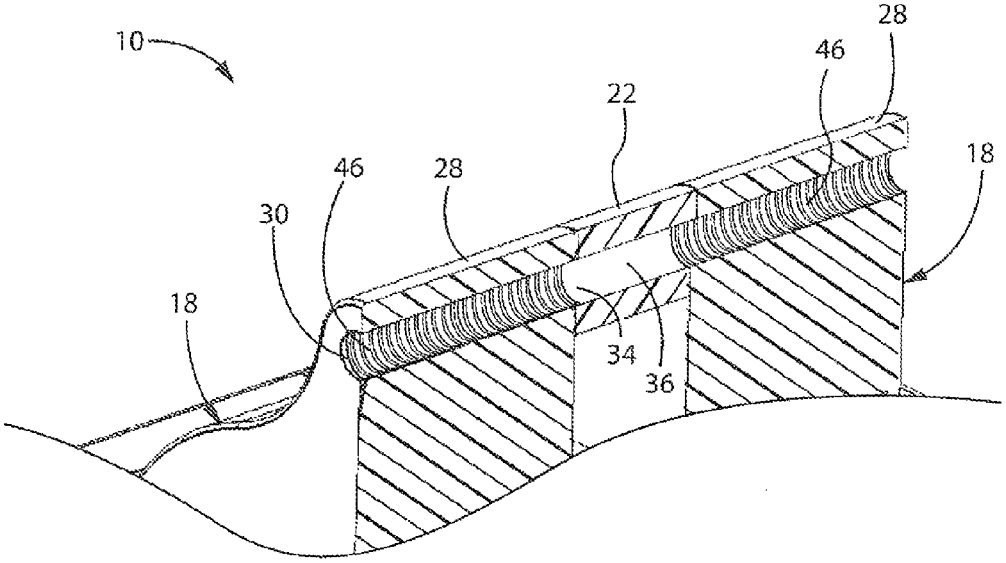
FIG. 5 is a partial section view of an alternative embodiment of the handle tie assembly in accordance with the present invention with the rod removed and showing threaded surfaces in the switch handle passages.
Figure 6:
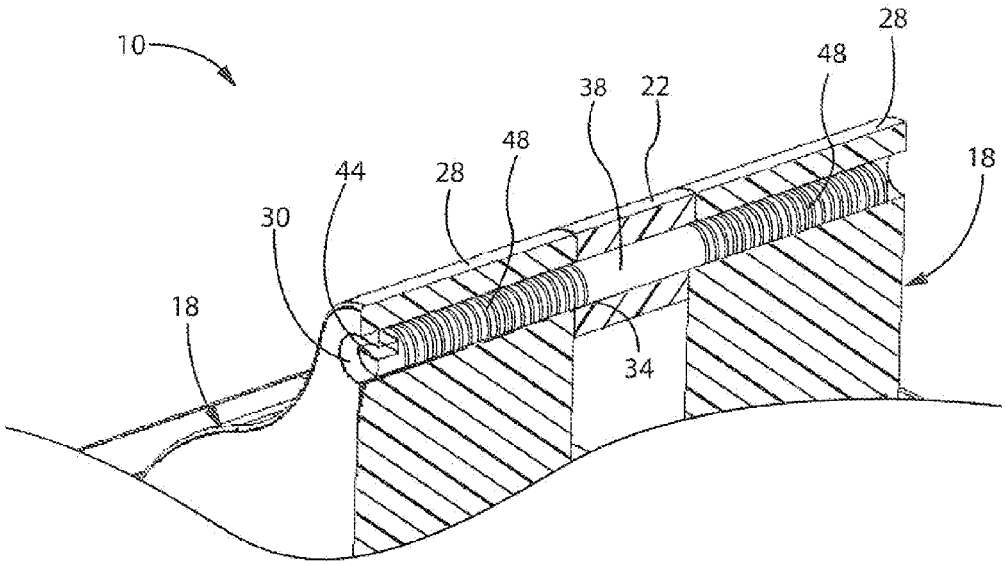
FIG. 6 is a partial section view of the handle tie assembly of FIG. 5 with the rod inserted therein and showing an outer surface of the rod having a threaded surface.

Referring now to FIGS. 5 and 6, an alternative embodiment of the present invention is shown having a second threaded arrangement of the switch coupling assembly 10. As shown, the inner walls 32 of the switch handle passages 30 have internal threads 46. Corresponding external threads 48 are provided on the elongated rod 38 at opposite outer sections disposed within the switch handle passages 30. The sections disposed within the spacer passage 34 may or may not be threaded.

As previously described, switch coupling assembly 10 is assembled by aligning the passages 30, 34 of the switch handles 18 and the spacer 22. The elongated rod 38 is then inserted through the passages 30, 34 by rotating the rod 38 so that the external threads 48 interlock with internal threads 46 and the rod 38 is allowed to advance linearly through the passages 30, 34. Thereafter, linear motion of the rod 38 is prevented so long as rotational force is not present. Similarly, the rod 38 may include notches 44 at opposite ends so that the rod 38 may be rotated by a screwdriver or other tool.

It is contemplated that the internal threads 40, 46 may be present in either or both of spacer passage 34 and switch handle passages 30, and is not limited to one or the other. Additionally, while the rod 38 is shown as having external threads 42, 48 only at the positions disposed within spacer passage 34 or switch handle passage 30, respectively, and as shown in FIGS. 3-6, it is also contemplated that the rod 38 may include external threads extending the entire length of the rod 38 for additional flexibility to practice either embodiment. It is also contemplated that the internal and external threads may be reversed while still achieving the same objective.

The threaded arrangement of the rod 38 and spacer 22, or rod 38 and switch handles 18 provides a secure attachment of the electrical switches 12, 14 and prevents inadvertent axial motion of the rod 38 relative to the spacer 22 and/or switch handles 18 while in operation. The coupling arrangement is easy to implement as a pre-molded cavity for switch handles 18 which have the necessary passages 30 in the switch handle tabs 28 for receiving the coupling rod 38, and a space provided between the switch handles 18 for receiving the spacer 22. Thus, the present invention ties the two switches or breakers together in a simple, elegant, and unobtrusive fashion.

Various alternatives and embodiments are contemplated as being within the scope of the following claims, which particularly point out and distinctly claim the subject matter regarded as the invention.

I claim:

1. A switch coupling assembly comprising:

a coupling rod defining a length and including an externally threaded portion that extends along at least a portion of its length;

at least two switches for use in at least one electrical circuit arranged in a side by side orientation and each having a switch handle movable to an on and off position and having passages that are aligned with each other when the at least two switch handles are in the on position and when the at least two switch handles are in the off position;

wherein the coupling rod extends into each of the switch handle passages for coupling the switch handles in a common orientation; and a spacer positioned between the switch handles and having a passage aligned with the passages of the switch handles and which receives the coupling rod therethrough for coupling the switch handles to the spacer;

wherein a threaded inner surface is provided on one of 1) the spacer passage and 2) at least one of the switch handle passages, wherein the external threads on the threaded portion of the coupling rod are threadedly engaged with the threaded inner surface, to prevent inadvertent axial motion of the coupling rod relative to the spacer and the switch handles.

2. The switch coupling assembly of claim 1 wherein the internal threads are provided in the spacer passage and the threaded portion of the coupling rod is disposed within the spacer passage and engaged with the internal threads of the spacer passage when the coupling rod is received within the switch handle passages, and wherein portions of the coupling rod disposed within the switch handle passages are unthreaded.

3. The switch coupling assembly of claim 1 wherein the coupling rod is a metal screw.

4. The switch coupling assembly of claim 1 wherein the spacer is a cylinder and the passage of the spacer extends between opposite ends defined by the spacer.

5. The switch coupling assembly of claim 1 wherein the switch handles are each disposed within an electrical switch housing adapted to fit within a transfer switch panel.

6. The switch coupling assembly of claim 1 wherein each switch is a circuit breaker.

7. The switch coupling assembly of claim 1, wherein the internal threads are provided in at least one of the switch handle passages and wherein the threaded portion of the coupling rod is disposed within the threaded switch handle passage and engaged with the internal threads of the switch handle passage when the coupling rod is received within the spacer passage.

8. The switch coupling assembly of claim 7 wherein a portion of the coupling rod disposed within the spacer passage is unthreaded.

9. The switch coupling assembly of claim 8 wherein the internal threads are provided in the passages of both of the switch handles between which the spacer is positioned and wherein the coupling rod includes a pair of threaded portions each of which is disposed within and threadedly engaged with one of the threaded switch handle passages.

10. A method of connecting switch handles of a pair of switches together, wherein each switch handle is movable between an on position and an off position, and wherein the switch handles have passages that are aligned with each other when the switch handles are in the on position and when the switch handles are in the off position, comprising the steps of:

providing a switch coupling assembly comprising:

a rod having a threaded portion; and a spacer configured to fit between the switch handles and having a passage;

wherein a threaded inner surface is provided on at least one of 1) the spacer passage and 2) one of the switch handle passages;

placing the spacer between the switch handles such that the spacer passage is aligned with the switch handle passages; and inserting the rod into the switch handle passages and through the spacer passage and threadedly engaging the threaded portion of the rod with the threaded inner surface to fixedly align the switch handles and provide simultaneous movement of the switch handles between the on and off positions.

11. The method of claim 10 wherein the step of inserting the rod into the switch handle passages and through the spacer passage comprises threadedly engaging the threaded portion of the rod with a threaded inner surface within the spacer passage.

12. The method of claim 10 wherein the step of inserting the rod into the switch handle passages and through the spacer passage comprises threadedly engaging the threaded portion of the rod with a threaded inner surface within at least one of the switch handle passages.

13. The method of claim 12 further comprising the step of threadedly engaging the threaded portion of the rod with a threaded inner surface within both of the switch handle passages.

14. The method of claim 11 wherein the inner surface of the spacer passage is threaded and the outer surface of the rod disposed within the spacer passage is threaded and a remaining outer surface of the rod is unthreaded.

15. The method of claim 13 wherein the inner surfaces of the switch handle passages are threaded and the outer surface of the rod disposed within each switch handle passage is threaded and a remaining outer surface of the rod is unthreaded.

* * * * *